US006968955B2

(12) United States Patent
Steeber

(10) Patent No.: US 6,968,955 B2
(45) Date of Patent: Nov. 29, 2005

(54) ELECTRIC EXTENSION CORD STORAGE DEVICE

(75) Inventor: Dorian Steeber, 334, Green Hill Dr., Anderson, SC (US) 29621

(73) Assignee: Dorian Steeber, Anderson, SC (US)

( * ) Notice: Subject to any disclaimer, the term of this patent is extended or adjusted under 35 U.S.C. 154(b) by 70 days.

(21) Appl. No.: 10/753,211

(22) Filed: Jan. 7, 2004

(65) Prior Publication Data

US 2005/0145534 A1 Jul. 7, 2005

(51) Int. Cl.[7] ..... B65D 85/00
(52) U.S. Cl. ..... 206/702; 206/388
(58) Field of Search ..... 206/388, 407–409, 206/702; 174/135; 242/580, 586, 595; 439/501

(56) References Cited

U.S. PATENT DOCUMENTS

| | | | | |
|---|---|---|---|---|
| 2,470,320 A | | 5/1949 | Page | |
| 3,733,478 A | | 5/1973 | Barker | |
| 3,809,331 A | | 5/1974 | Gaul | |
| 4,979,614 A | * | 12/1990 | Ruhaut | 206/702 |
| 4,984,685 A | * | 1/1991 | Douglas | 206/702 |
| 5,103,977 A | | 4/1992 | Douglas | |
| 5,139,141 A | * | 8/1992 | Dickie | 206/702 |
| 5,421,457 A | | 6/1995 | Listenberger | |
| 5,449,067 A | * | 9/1995 | Cannon | 206/702 |
| 5,586,655 A | | 12/1996 | McBride | |
| 5,772,036 A | * | 6/1998 | Muncy et al. | 206/702 |
| 5,848,701 A | | 12/1998 | Riccabona | |
| 6,189,258 B1 | | 2/2001 | Anderson | |
| 6,848,937 B1 | * | 2/2005 | Hsiao | 439/501 |

* cited by examiner

*Primary Examiner*—Luan K. Bui
(74) *Attorney, Agent, or Firm*—Dority & Manning, P.A.

(57) ABSTRACT

A storage device for an electric extension cord having a male end and a female end is provided. The storage device includes a rigid container for holding the electric extension cord. The container has sidewalls which form an outer perimeter of the container and form a container opening in a top portion of the container. The sidewalls of the container also form at least one indention in the outer perimeter of the container proximal to the container opening. Further, the sidewalls form at least one aperture in the at least one indention to permit the male end and female end of the extension cord to be extendable outside of the container when the extension cord is placed in the container. At least one locking device is positioned in the at least one indention formed in the outer perimeter of the container proximal to the at least one aperture formed by the sidewalls. The at least one lock device holds the male end and the female end of the extension cord within the at least one indention in the outer perimeter. A lid for covering the opening of the container is attachable to the container.

28 Claims, 7 Drawing Sheets

ELECTRIC EXTENSION CORD STORAGE DEVICE

BACKGROUND OF THE INVENTION

This invention concerns a storage device for an electric extension cord including a container and lid that allows for easy storage, while providing protection to and preventing entanglements of the extension cord.

Extension cords are essential accessories for residential, industrial, and commercial use of electrical items. They free electrical devices from the requirement of only being operated within a relatively short distance of five or six feet from a power source, like a receptacle. Extension cords permit the use of such electrical devices twenty-five, fifty, or even over 100 feet away from the power source, which proves to be invaluable. The extension cords are so long that they must be condensed into a manageable shape to be transported to the location of use or to be stored when not in use. However, problems arise with repeated storage and retrieval of these extension cords.

Conventionally, extension cords have been stored by manually winding or looping them into a coil that allows the cords to be easily handled, transported, and stored. Such a method is time consuming and can be awkward to perform. The coiled extension cord creates opportunities for the cord to become entangled with other objects in the storage area. Further, the turning of a cord as it is being wound creates a twist in the cord, which causes other concerns. The twist generated in the cord stays in the cord to a certain extent due to its length. This twist causes a cord to curl and twist on itself making the cord hard to handle and greatly increases the likelihood of knots and entanglements forming in the cord. Such knots and entanglements can create a hassle for the user to undo at best, or, at worst, can cause the life of the cord to be shortened or even damage the cord to the point of rendering it useless.

Automatic and manual spindle and reel arrangements have been developed that provide easier and faster methods to wind the extension cord into a coil. When in use, the extension cord is removed from these spindle and reel arrangements by pulling the cord off the reel, thereby causing the reel to rotate around the spindle in an unwinding direction. The cord is returned to the reel by turning the reel around the spindle in a counter winding direction. The reel, in most cases, will be turned manually though some varieties can be automatically rewound through spring actuated return reels. The arrangements provide an easier way to transport the extension cord than the manually made coil of cord.

These spindle and reel arrangements, however, add excessive weight to extension cords when transporting the extension cords. Such arrangements may require the extension cords to be attached to the spindle and reel arrangements, thereby adding bulk to the extension cords that can limit their usefulness. Further, these spindle and reel arrangements do not address twist build up in the cords caused by winding the cords into a coil, and may actually perpetuate the problem. The extension cords stored on such spindle and reel arrangements still tend to twist and curl, causing knots and entanglements in the cords when the cords are removed from the arrangement and are not fully extended.

Other methods and devices have been suggested for storage of an electric extension cord. For example, U.S. Pat. No. 5,421,457 discloses a cord bucket having a tight fitting top. The bucket provides a cut slot in its side to insert one end of an electric extension cord, while a central dome forming an aperture in the top provides a guide means for the other end of the cord. The user pulls the extension cord out of the cord bucket by pulling it through the central dome aperture and the cord is returned by pushing the cord back through the same aperture. In this manner, the cord is not wound or twisted into a coil. The slot formed in the side of the bucket tightly grips through friction the part of the extension cord that is inserted therein, so that the end of the extension cord extends on the outside of the bucket. When the extension cord is stored in the bucket, the opposing end of the cord sticks out of the top through the aperture of the central dome. The central dome with the aperture is designed to frictionally retard the movement of egress and ingress of the cord as it is pulled out of and pushed into the cord bucket. The cord bucket can further have a pivotal handle that connects to the sides of the bucket so that the handle can pivot over the top of the bucket from one side to the next. The pivotal handle provides a means to transport the bucket.

A major disadvantage in this bucket design still exists in that entanglements can still occur on a frequent basis. The method of pushing the cord back into the cord bucket through the friction gripping central dome prevents the winding of the extension cord. However, as the extension cord is pushed back into this limited space, experience has shown that the cord has a tendency to loop back around itself. When the extension cord is pulled back out, the loops tighten forming entanglement and knots. The entanglements and knots are difficult to get out, especially since the end of the cord is extending through the top of the bucket.

Also, due to friction grip of the central dome of the top around the cord, the end protruding therethrough is not easily removed from the top, making the cord essentially attached to the top of the bucket. This attachment is not only a problem for entanglements due to the cord insertion method for this device, it also makes the cord bucket cumbersome to use. One of the benefits an extension cord provides is that it allows a user to access electricity for utilizing the user's electrical products in a multitude of locations. Having a bucket or a top of a bucket attached to the cord limits this versatility of the cord by essentially always having an unnecessary item attached to the cord that can restrict the movement of the cord, especially when a cord has to be fully extended.

The insertion method for putting the cord in the cord bucket also is cumbersome to perform. Experience has shown that the more full the cord bucket becomes as the extension cord is inserted, the harder it is to insert the cord. By the time the user starts to insert the last few feet of extension cord, he or she must force and cajole the cord through the aperture in the central dome of the top. It ends up taking the user longer to insert the cord than to have wound it by hand.

The friction grips at the slot in the side of the bucket, and especially at the aperture of the central dome, can cause further problems. These friction grips put pressure on the extension cord as the cord is pulled out and pushed into the bucket. This frictional pressure along the cord that comes with continued use as it is pulled out and pushed in the cord bucket causes the insulation to deteriorate and wear down within the outer cover of the cord. The deterioration of the insulation leads to a less effective extension cord or worse. The cord without proper insulation can short circuit.

Also, the design of this cord bucket leaves the ends of the cord dangling on the outside of the cord bucket. The male end and female end of the cord have little if any protection against abrasions, unnatural bending, and general exposure to the outer environment. This dangling of the ends of the extension cord increases the likelihood that damage will occur to the cord ends. Further, a pivotal handle, which pivots around the opening of the bucket, provides another component on which the cord can entangle.

Traditional marketing methods used to sell extension cords may also perpetuate the problems caused by winding the extension cord into a coil. Electric extension cords sold in most hardware or home improvement stores are wrapped in a coil that have been tied together in some manner. The coiling of the extension cord as stated above adds twists and kinks to the cord that increases the likelihood that the cord will become entangled or knotted at a later time.

A need still exists for a storage device for an electric extension cord that does not require the extension cord to be wound into a coil and prevents the likelihood of entanglements and knots, while providing easy and quick storage. A need also exists for providing protection to both the cord and the cord ends without exposing the cord and cord ends to any unnecessary opportunities for damage.

SUMMARY OF THE INVENTION

The present invention recognizes and addresses the above-briefly discussed drawbacks, and others, of the prior art storage devices. Accordingly, a general aspect of the present invention is to provide a device that promotes easy and quick storage and use of an electric extension cord while not requiring the extension cord to be wound into a coil and preventing the likelihood of entanglements and knots. Another aspect of the present invention is to provide protection to both the cord and the cord ends from any undue damage. Additional aspects and advantages of the invention will be set forth in part in the following description, or may be obvious from the description, or may be learned through practice of the invention.

In accordance with the principal aspects of the present invention, a storage device for an electric extension cord is described that provides an easy way to store and protect electric extension cords in a manner that prevents entanglements within the cord and allows quick and easy distribution and insertion of the cord. In an exemplary embodiment, the storage device according to the present invention includes a rigid open container for holding the electric extension cord and an attachable lid for closing the container. The container has sidewalls that form an outer perimeter of the container and form a container opening in a top portion of the container along an edge of the sidewalls. The sidewalls of the container also form an indention in the outer perimeter of the container proximal to the container opening. Further, the sidewalls form an aperture in the indention in the outer perimeter of the container.

This aperture permits the male end and female end of the extension cord to be extendable outside of the container when the cord is placed in the container. This aperture may be a through-hole, a slot, a recess, etc. In some embodiments, it is preferable for the aperture in the indention of the sidewalls of the container to be wide enough to engage the cord in a non-binding manner, meaning it should not frictionally grip the cord or cause any undue friction on the cord.

A locking device is positioned in the indention formed in the outer perimeter of the container proximal to the aperture formed by the sidewalls. This locking device holds the male end and the female end of the extension cord within the indention in the outer perimeter. In other embodiments, multiple locking devices may be employed. In fact, more than one locking device may be used to hold each end of the cord within the indention.

When the extension cord is inserted into the container for storage, the user places a first end (male or female) of the cord on a locking device in the indention. The cord is then placed through the aperture and the cord is inserted into the container in a first-in last-out fashion. No winding or looping is necessary and is, in fact, discouraged. The user can place handfuls of cord into the container at one time. Once the cord is placed in the container, the portion of the cord close to a second end is placed through the aperture in the indention and the second end is attached to the locking device. The random first-in last-out placement of the cord in the container is more easily performed and less tedious than winding the cord into a coil, and it also better protects and preserves the integrity of the extension cord. Further, the ends of the cord are protected from undue wear and abrasion by being held within the indention by the locking device.

In a further embodiment, the sidewalls forming the indention also form a first recess and a second recess along the edge of the sidewalls integral to the container opening. The first recess permits the first end and the second recess permits the second end to be extendable outside of the container when the cord is placed in the container.

In this embodiment, a first locking device and a second locking device are positioned in the indention formed in the outer perimeter of the container. The first locking device for holding the first end of the extension cord is proximal to the first recess formed by the sidewalls, while the second locking device is proximal to the second recess formed by the sidewalls for holding the second end of the extension cord. In this manner, the first and second locking devices hold the first and second ends of the extension cord within the indention in the outer perimeter.

In some embodiments, more than one indention may be provided. In some preferred embodiments, two indentions are provided with a recess formed by the edge of the sidewalls and a locking device in each indention. In such embodiments, the sidewalls form two apertures, such as a through-hole, slot, or recess so that one of the two apertures is located in each of the two indentions, thereby each aperture permitting one of the ends of the extension cord to be extendable outside of the container when the extension cord is placed in the container. Also, two locking devices are positioned on the sidewalls in each of the two indentions proximal to the aperture to hold the ends of the cord in the indention. This construction permits each end of the extension cord to be inserted into an indention.

To close the storage device, a lid for covering the opening of the container is provided to attach to the container. In some embodiments, the lid may have an outer surface that permits multiple storage devices to be stacked atop one another. This outer surface may be flat or at least provide a flat enough surface to allow such stacking depending on how the bottom of the container is configured.

The lid may be attached to the container in a multitude of ways. The lid may form an annular snap catch that engages a snap ring encircling the container by applying pressure to the lid, thereby snapping the lid onto the container. In other embodiments, the lid may possess a circle snap ring that engages a snap catch on the interior of the container. The lid and container may also form corresponding threads to allow the lid to be screwed onto the container. In a further embodiment, the container may possess detents on the sidewalls with a lid having screw threads that engage the detents, thereby locking the lid to the container.

In some exemplary embodiments, the storage device possesses a handle that allows the storage device to be easily transported to the user's intended destination. Preferably, the handle should be integral to the storage device in a manner that prevents it from providing an element of the storage device that can be easily entangled with the extension cord. In one such exemplary embodiment, the container defines a handle by which the storage device may be lifted. Such a handle may be formed by the sidewalls of the container. The handle may be a pinch handle formed by indentions in the sidewalls, or may be a through handle, which allows the user to enclose his or her hand around the handle.

In other exemplary embodiments, the lid may define the handle by which the storage device may be lifted. As with the handle formed by the container, the handle may be a pinch handle formed by indentions in the outer surface of the lid, or the outer surface may form a through handle. As with the other embodiments, the handle may be flush with the outer surface of the lid permitting the storage device to be stacked atop another. These types of handles on the lid or the container provide an easy way to transport the storage device without supplying the extension cord with another component in which to get entangled.

The locking devices can hold the ends of the extension cord within the indention to protect the extension cords in many different ways. The locking devices can be male shaped extensions attached to the sidewalls within the indention that correspond to a female receptor on each of the ends of the cord. In this manner, the ends of the cord may be slid onto the locking devices to hold the ends within the indentions formed by the outer perimeter. In other exemplary embodiments, the locking devices are a female plug-in that accepts the male end of the cord and a male plug that enters the female end of the cord. With such locking devices, the ends of the plugs are attached to the sidewalls of the invention similar to the manner in which they are plugged in for use. Other embodiments may have snaps that permit the ends of the cord to snap onto the sidewalls in the indention. In still further embodiments, the locking devices may be clips into which the extension cord fits. Each end of the extension cord can be held in the indention by placing a part of the extension cord proximal to that end in the clip.

In all the embodiments, the design of the container and lid better protects the cord and cord ends from unnecessary damage and wear than the prior art. Other features of the present invention will be described in greater detail below through the use of the appended figures.

DETAILED DESCRIPTION

Reference will now be made in detail to the presently preferred embodiments of the invention, one or more examples of which are shown in the figures. Each example is provided to explain the invention and not as a limitation of the invention. In fact, features illustrated or described as part of one embodiment can be used with another embodiments to yield still a further embodiment. It is intended that the present invention cover such modifications and variations.

Figure 1:
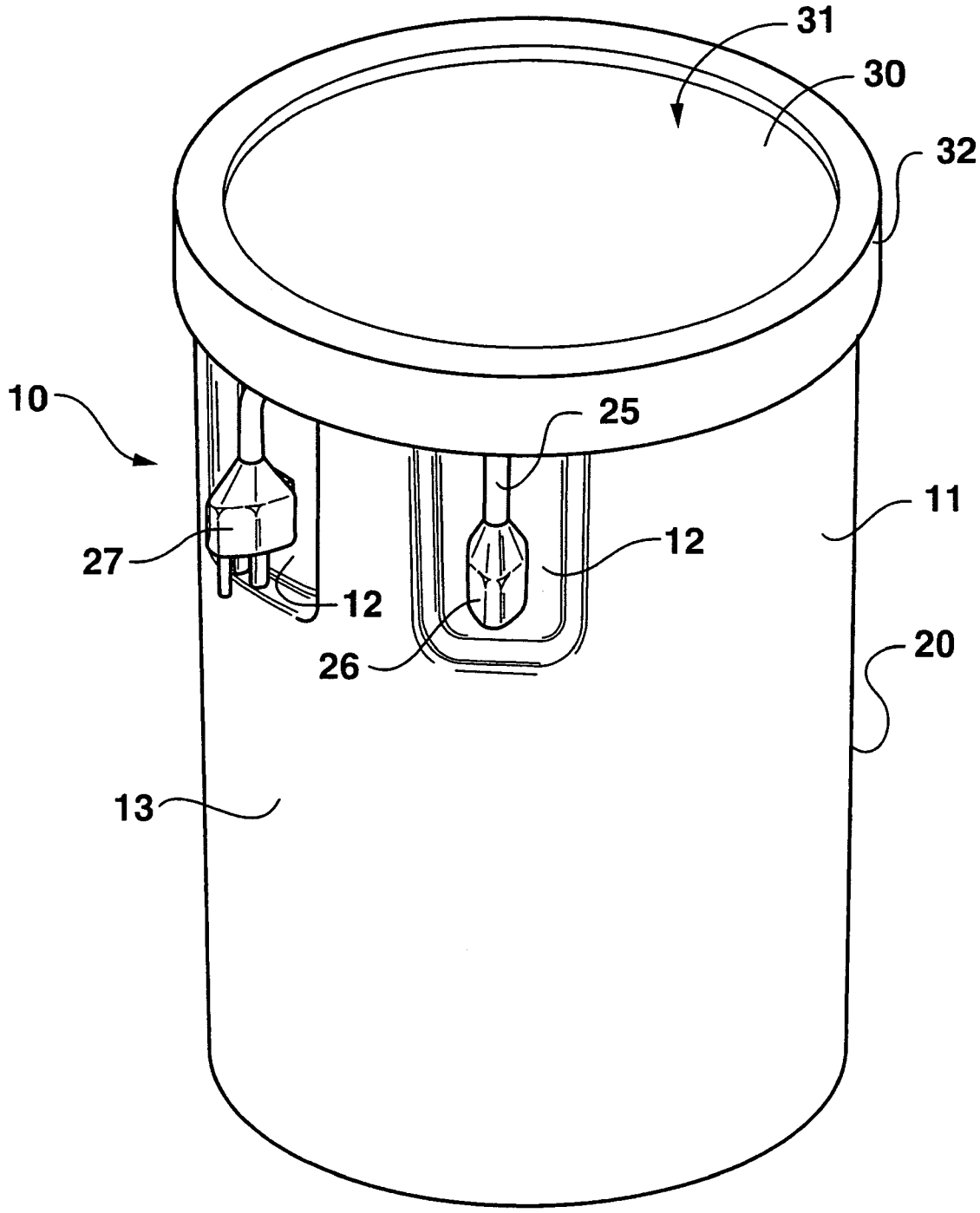
FIG. 1 shows a perspective view of an embodiment of a closed storage device for an electric extension cord according to the present invention.

FIG. 1 shows a storage device, generally 10, including a rigid container 20 and a lid 30. The storage device is for housing an electrical cord 25 within the confines of the container 20. The container 20 includes sidewalls 11 that form an outer perimeter 13 of the container 20. These sidewalls 11 form indentions 12 in the outer perimeter 13 that are proximal to an opening in the container 20. The basic shape of the container 20, shown in a cylindrical shape by way of example only, may be any shape that holds the extension cord 25 and permits a lid 30 to be attached thereto to cover the opening. Ends 26, 27 of the extension cord 25 attach to the sidewalls 11 in the indentions 12. The extension cord 25 is placed into the container 20 when it is open by attaching an end, such as female end 26, to the sidewall 11 in indention 12. The cord is then inserted into the bucket in a random fashion with the part of cord 25 closest to female end 26 entering the container first and the rest of the cord following. The male end 27 of the cord is then attached to the sidewall 11 in the other indention 12. The lid 30 is then placed on the container 20.

The lid 30 has a relatively level outer surface 31 on top that allows objects, including other storage devices, to be stacked on top of the storage device 10. The lid 30 also has a rim 32 that attaches the lid to the container in some manner, thereby protecting the extension cord 25 from the environment surrounding the container 20. Each of the ends 26, 27, or at least parts of the cord 25 close to these ends 26, 27, fit through an aperture, which may be a through-hole, slot, recess, etc., in the container (not shown in FIG. 1) located in both indentions 12 to allow the ends 26, 27 of cord 25 to be attached on the outside of the container 20 in the indention 12. The indentions have a depth such that, when the ends 26, 27 are attached to the sidewall 11 in a respective indention 12, the ends 26, 27 are held and protected from any damage caused by abrasion, bending, or any other unwanted contact.

Figure 5:
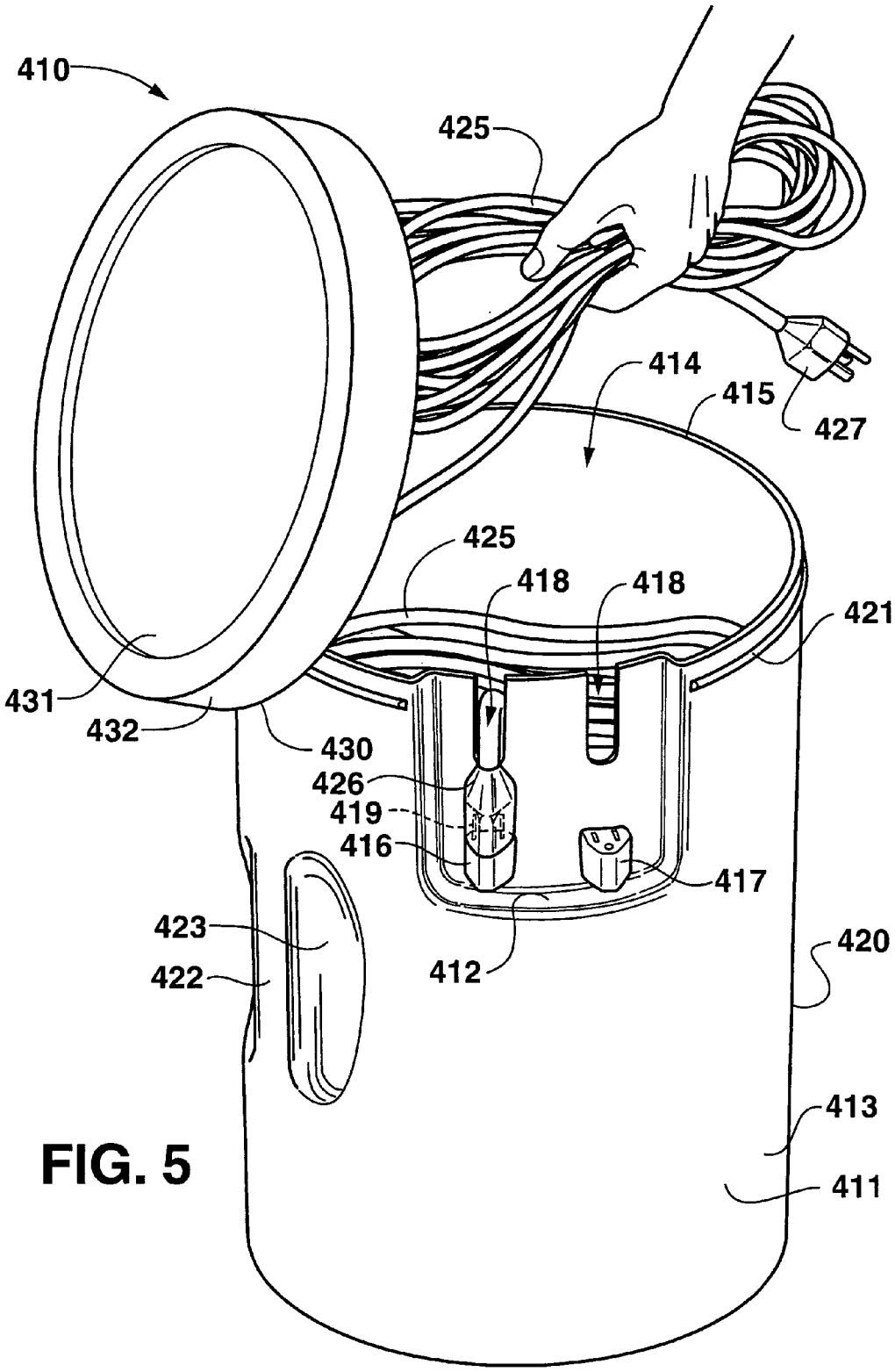
FIG. 5 shows a perspective view of a further embodiment of a storage device for an electric extension cord according to the present invention that is in the process of being loaded.

As can be seen in FIG. 5, another embodiment of a storage device, generally 410, is shown having a container 420 and a lid 430. In this embodiment of the storage device 410, sidewalls 411 form an outer perimeter 413 in such a manner that the sidewalls 411 form only one indention 412. Further, these sidewalls 411 form an edge 415 around the top of the container 420. The container 420 has an opening 414 that extends to the bottom of the container 420. The sidewalls 411 form two apertures 418 within the indention 412. Locking devices 416 and 417 are placed below the apertures 418. In the embodiment shown, locking device 416 is a male extension with male prongs 419 (shown as dotted lines) so that a female end 426 of a cord 425 can be plugged thereon. Conversely, locking device 417 is a female receptor that can receive a male end 427 of the cord 425.

To place the cord into the storage device, the user will plug the female end 426 of the cord 425 onto the male locking device 416 by inserting the prongs 419 into the female receptors of the female end 426 with the cord draped through the aperture 418 above the male locking device. The cord 425 is then placed into the container 420 in a random first-in last-out fashion with the part of the cord 425 closest to the female end 426 going into the container first. Preferably, the cord 425 may be dropped or placed into the container 420 in bunches as shown in FIG. 5. This method allows for particularly quick insertion. Once all the cord is in, the male end 427 of the cord 425 is then placed in the aperture 418 above female locking device 417 so that the male end 427 is then plugged into the female locking device 417, thereby protecting the ends 426, 427 of the cord 425 within the indention 412.

It should be understood that apertures 418 may be recesses, through-holes, slots, etc., having a sufficient size and shape to receive the cord therein. Preferably, the apertures 418 are wide enough to prevent frictional contact between the cord 425 and the container 420, thereby creating a non-binding engagement between the sidewalls 411 that form the aperture 418 and the cord 425. This non-binding engagement prevents undue wear on the cord due.

The indention 412 and the apertures 418 should extend far enough down towards the bottom of the container 420 so that when the ends 426, 427 are plugged into the locking devices 416, 417, the cord is not unnaturally bent, thereby also protecting the cord, and especially the insulation within the cord, from undue wear. Further, in most preferred embodiments, indention 412 is deep enough to allow the ends 426, 427 of the cord 425 to fit within the outer perimeter 413 of the container 420, meaning that no part of the ends 426, 427 extend outside the indention 412. In this manner, the ends 426, 427 are better protected then if the ends were just dangling outside the container. Meanwhile, the rest of the cord 425 is protected within the container and lid, thereby preventing undue wear on both the cord and its ends.

Further, by attaching the ends 426, 427 of the extension cord 425 to the locking devices 416, 417, the ends 426, 427 are prevented from interacting with the cord 425 within the container 420. The ends 426, 427 are thus prevented from slipping through loops in the cord 425, thereby further limiting the opportunities for entanglements. The ends 426, 427 cannot get lopped around and through the cord 425 due to the attachment of the ends 426, 427 within the indentions 412, which is a major advantage. By controlling the ends 426, 427 of the cord 425, the opportunity for entanglements is greatly limited.

In the embodiment shown in FIG. 5, the container 420 has a snap-on ring 421 that extends around the container top near the opening 414. The lid 430 has indentions (not shown) around the interior of a rim 432 that allow the lid 430 to be snapped onto the top of the container 420, thereby closing the opening 414 when the cord 425 has been placed in the container 420. As with the container in FIG. 1, the lid 430 has at least a portion of a top outer surface 431 that is relatively level to allow the storage device 410 to be stackable.

In the embodiment shown, the sidewalls 411 of the container 420 also form a handle 422 on the side of the container 420. The handle 422 is a pinch handle that is formed by indentions 423 that are located on either side of the handle 422. The handle allows the storage device 410 to be carried when the extension cord 425 is enclosed in the container 420 by the lid 430. The attachment of the lid 430 to the container 420 should be strong enough to hold the cord 425 within the storage device 410 when the storage device 410 is held by the handle 422 on the side of the container 420. In this way, the storage device is easily transported in an easy and safe manner.

When the user gets to his destination for use, the lid 430 can be easily removed by gripping the lid at the indention 412 and pulling it off. The cord ends can be removed from the locking device and the cord can be taken out of the container. If the user is in a hurry, the cord may even be thrown out of the container, preferably by holding the end of the cord that was first placed in the container. The cord 425, in this manner, is extended in a tangle free way without the kinks that are inherent in extension cords that are coiled, thereby minimizing opportunities for knots and other entanglements to occur.

When the user is through using the extension cord 425, it can be reinserted into the container 420 by placing either end 426 or 427 back into its corresponding locking device 416 or 417 and inserting the cord in a random first-in last-out fashion with the other end 426 or 427 being plugged into its corresponding locking device 416 or 417. At this point, the lid 430 with its rim 432 can be snapped back on to the snap ring 421 surrounding the top of the container 420 near the opening 414.

Figure 6:
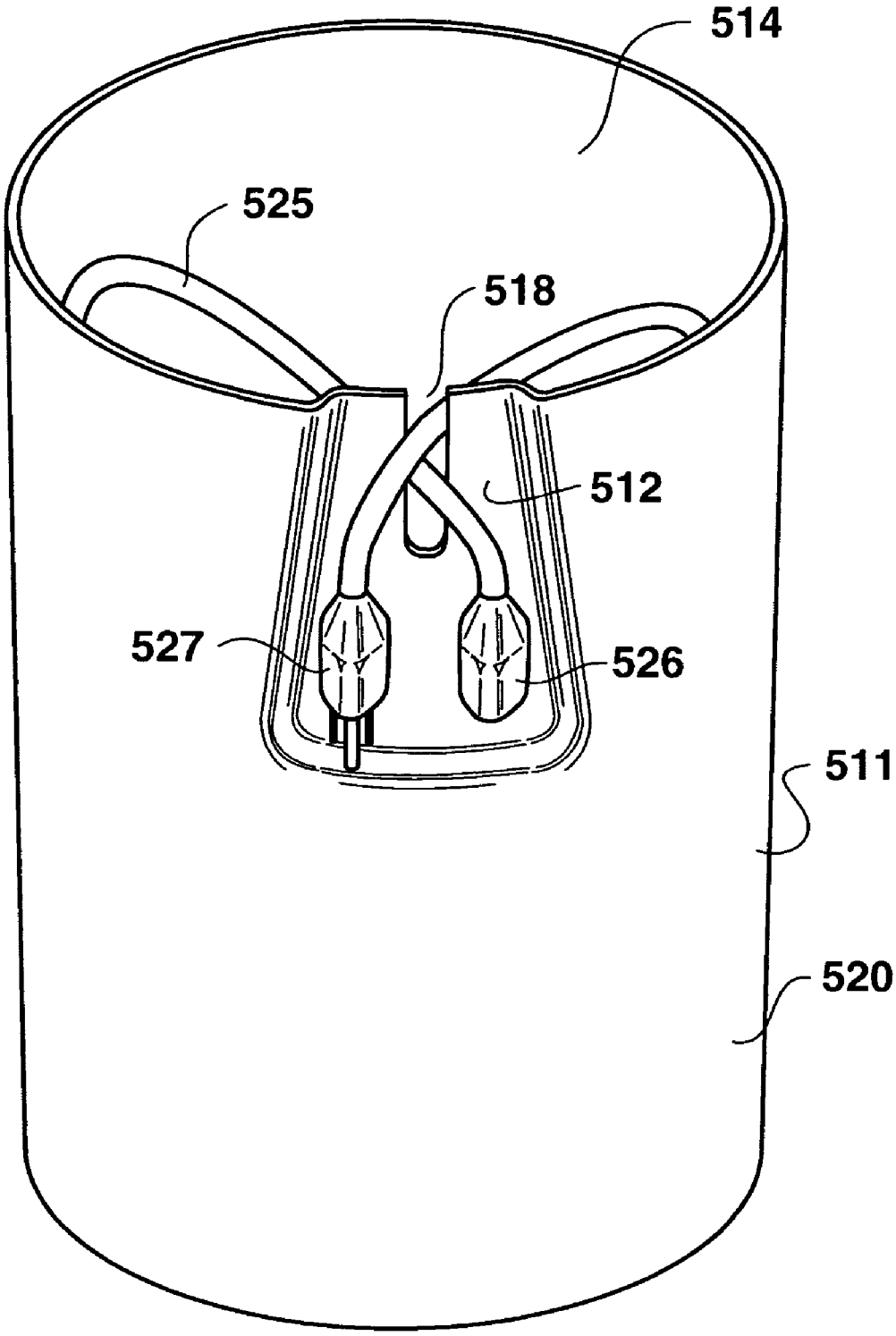
FIG. 6 shows a perspective view of an embodiment of a container of a storage device for an electric extension cord according to the present invention.

It should be well understood that a single aperture may be used instead of having two apertures as long as the aperture is big enough to handle insertion of both portions of the cord near the ends. In fact, in some embodiments, it may be advantageous to have just one aperture to make it easier for the user to know which end of the cord should be detached from its locking device first when removing the cord from the container. As seen in FIG. 6, which shows a container 520 of a storage device, a single aperture 518 may be formed by sidewalls 511 of the container 520 in an indention 512. The user attaches a first end, such as female end 526, of an extension cord 525 to a locking device in the indention 512. The extension cord 525 is placed through the aperture 518 and into an opening 514 of the container 520. When the user finishes placing the cord in the container 520, the second end, such as male end 527, of the extension cord 525 is attached to another locking device in the indention 512. In such a container 520, a portion of the extension cord 525 near the end 527 lays on top of a portion of the extension cord 525 near the end 526. In a storage device that uses such a container 520, the user knows that the top end, male end 527, was the last one into the container and is forced to detached that end first to deploy the extension cord 525 without need of any further instruction.

Figure 2:
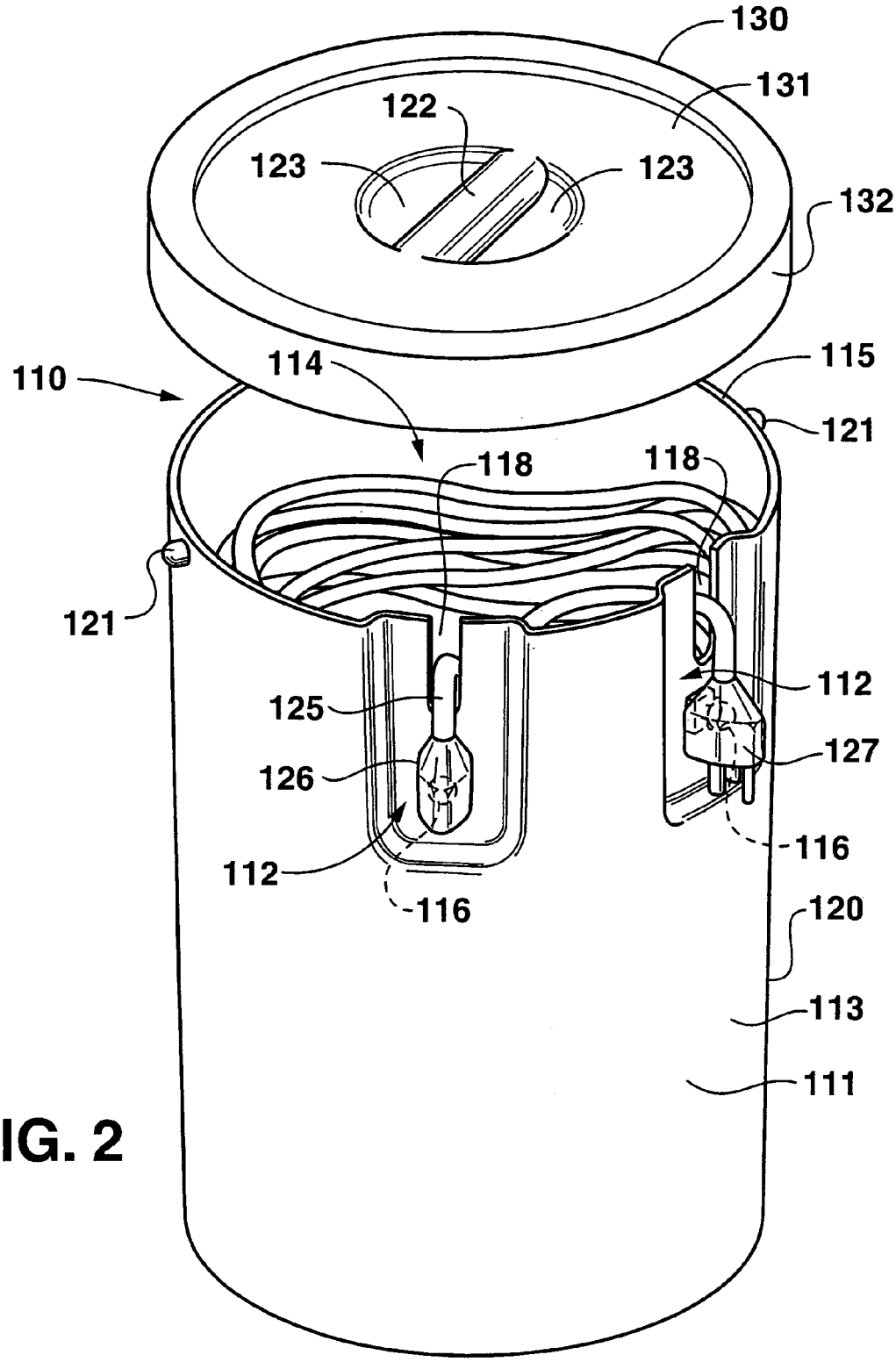
FIG. 2 shows an exploded perspective view of another embodiment of a storage device for an electric extension cord according to the present invention.

FIG. 2 shows a further embodiment in which a storage device 110 includes a container 120 having two separate indentions 112 in an outer perimeter 113 of the container 120 formed by sidewalls 111. Cord ends 126, 127 of a cord 125 extend out of an opening 114 of the container 120 with the part of the cord 125 closest to these ends 126, 127 extending through recesses 118 present in both indentions 112. These recesses 118, which are formed by an edge 115 of the sidewalls 111, are integral to the opening 114. As before, these recesses 118 allow the cord 125 to have its ends 126, 127 extend on the outside of the container 120 without having to contact the edge 115 of the sidewalls 111, thereby preventing any undue friction on the cord that would damage the outside of the cord 125 or damage the insulation within the cord 125.

The male end 127 and the female end 126 are attached to the sidewalls 111 within the indention 112 by snap buttons 116 that are denoted by broken lines. The snap buttons 116 that are on the inside of the ends 126, 127 connect to snaps on the sidewalls 111 within the indention 112 so that the ends 126, 127 of the cord 125 are prevented from hanging wildly outside of the container 120. The attaching of the ends 126, 127 to the snap buttons 116 controls the ends 126, 127, thereby limiting the opportunity for entanglements within the core. In such an embodiment, either end 126, 127 may be snapped into either of the indentions 112. Preferably, these snap buttons 116 are made of a plastic or some other non-conductive material. With all these embodiments, it does not matter which end is attached to the sidewalls of the indention first when inserting the cord 125 into the container 120, unless there is a specific reason to have a specific end coming out of the container 120 first, or vice versa.

The storage device 110 also has a lid 130 having a pinch handle 122 formed by indentions 123 in a top outer surface 131 of the lid 130. The lid 130 also has a rim 132 that can turnably engage detents 121 attached to the container 120 near the opening 114. The lid 130 may be placed over the opening 114 of the container 120 and rotatably locked by turning the lid 130 in a specified direction causing the rim 132 to engage the detents 121 as is known in the art. The pinch handle 122 allows the lid 130 to be easily twisted to lock it in place. In the same manner, the lid 130 may be twisted in the reverse direction by the pinch handle 122 to unlock and remove the lid 130. In most embodiments, it is preferable to have the handle 120 relatively flush with the top outer surface 131 of the lid 130. Again, this allows objects or other storage devices to be stacked atop the storage device 110. Once the lid 130 is locked onto the container 120, the storage device 110 may be carried around by the handle 122 without fear of the container 120 detaching from the lid 130.

Figure 3A:
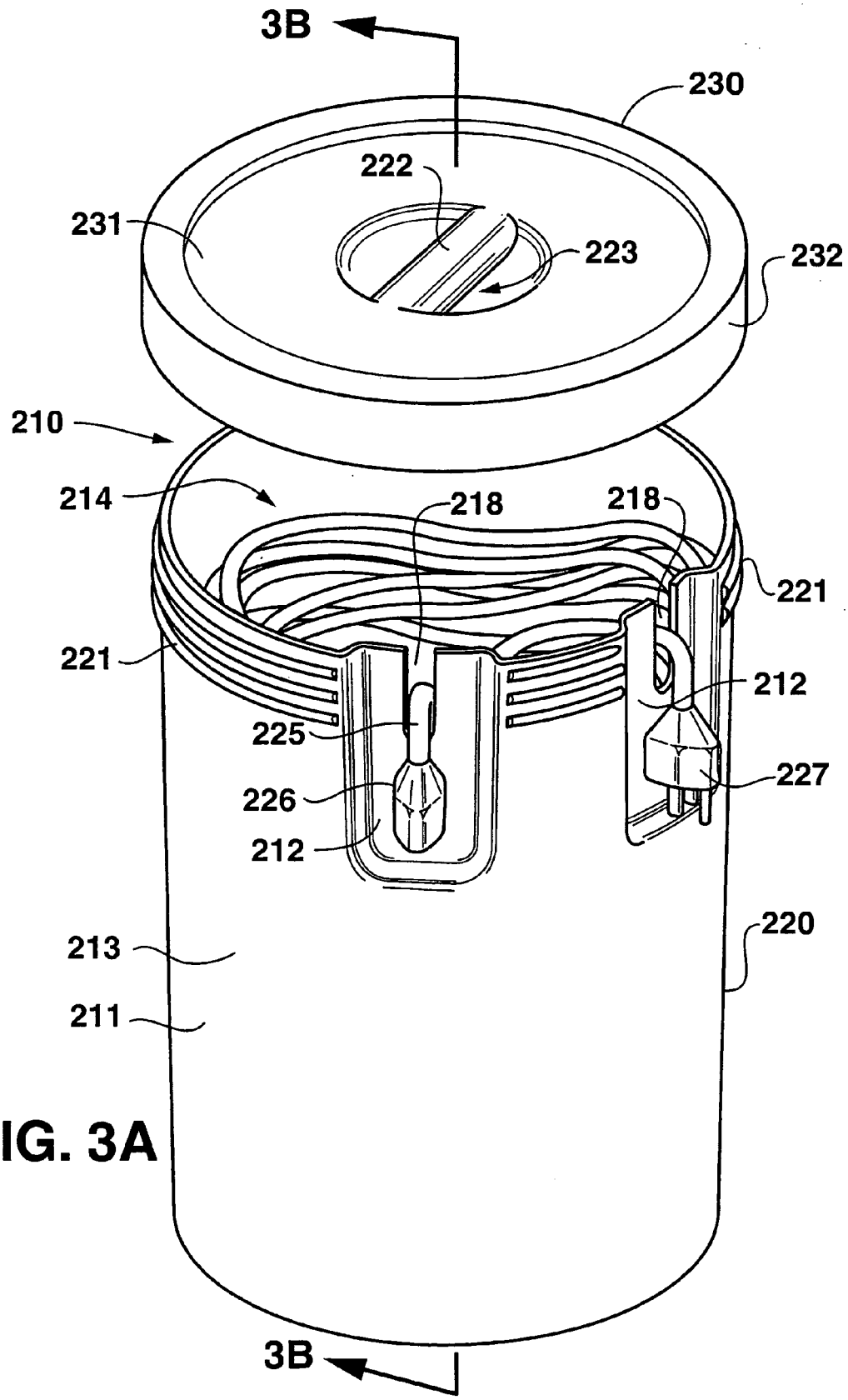
FIG. 3A shows a side view of another embodiment of a storage device for an electric extension cord according to the present invention.
Figure 3B:
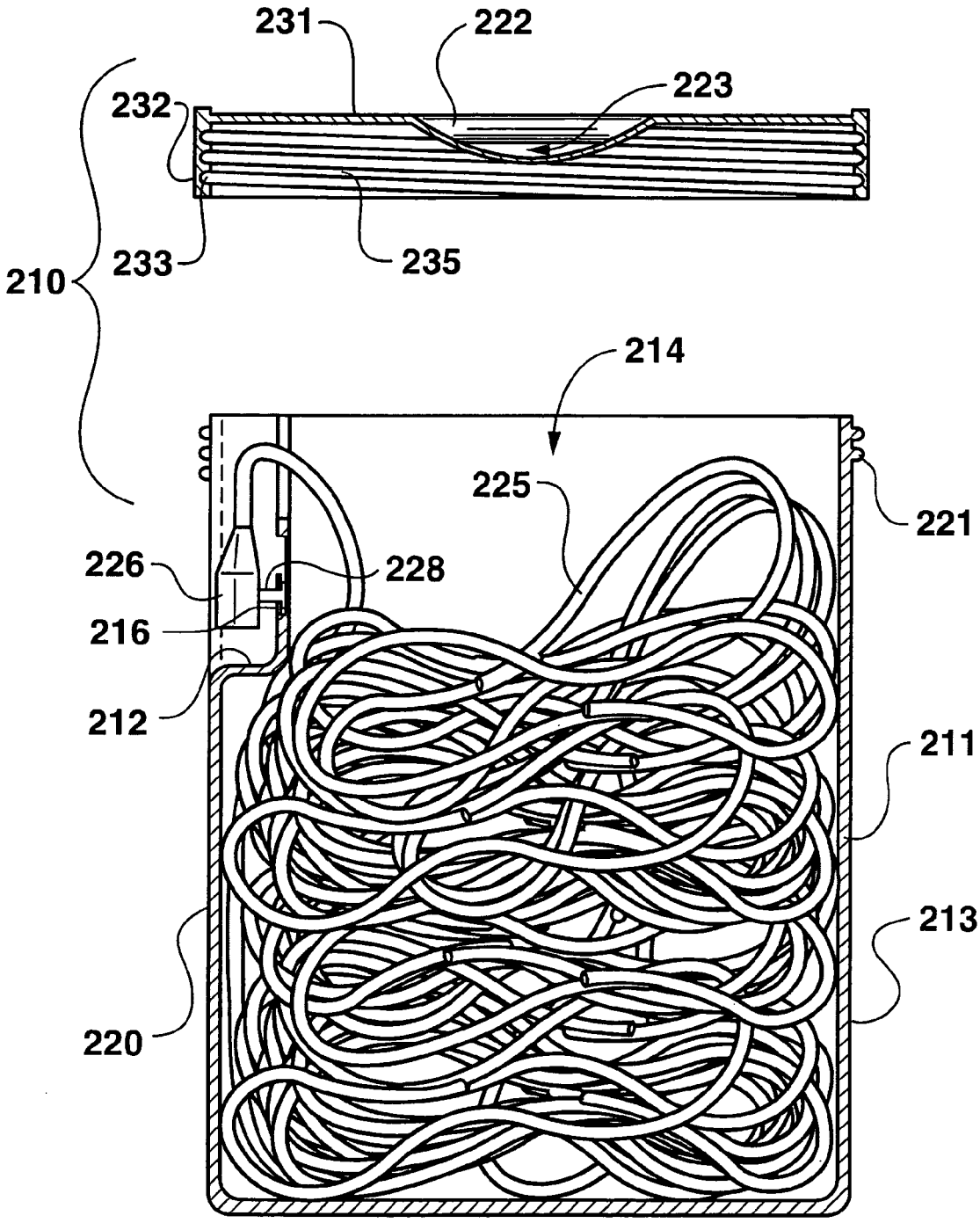
FIG. 3B shows a cut-away view along section line I and II of the storage device shown in FIG. 3A.

FIGS. 3A and 3B show a further embodiment of the invention. A storage device, generally 210, has a container 220 and a lid 230 that may be screwed onto the container 220. The container 220, as in other embodiments, has sidewalls 211 that form an outer perimeter 213 with the sidewalls 211 forming two separate indentions 212 in the outer perimeter 213 of the container 220. Recesses or slots 218 are formed in an upper portion of the container within the indentions 212. At the top of the container, screw threads 221 encircle the container 220.

A female end 226 and a male end 227 of a cord 225 are locked into the side of the container 220 in the indentions 212. Both the female end 226 and the male end 227 have a stem 228, which can be placed into a keyhole shaped slot forming a locking device 216 in the indention 212, thereby holding the ends 226 and 227 of the cord 225 in place. As can be seen in the cutaway view in FIG. 3B, the female end 226 is placed in a locked position and then the cord 225 is randomly placed in an opening 214 of the container 220 in a first-in last-out positioning. The male end 227 is then placed in its slot 218 of the indention 212 after the cord has been disposed in the opening of the container 220 and its stem is placed in the key-slot locking device. As can be seen from the side view, the end 226 is contained within the indention 212 formed by the sidewalls 211 in the outer perimeter 213 of the container 220, thereby protecting and controlling the female end 226.

The lid 230 of the container 220 has a through handle 222, which is flush with a top outer surface 231 of the lid 230. As in other embodiments, the essentially flat top outer surface 231 allows the storage device 210 to be stackable. In some embodiments, the handle does not have to be totally flush; however, it is ideal to have the handle 222 flush enough to allow objects to be placed upon the storage device. The through handle 222 and the lid 230 form an aperture 223 that runs underneath the handle 222 to allow the user to fully grip the handle, thereby permitting the user to turn the lid 230 in its appropriate direction to tighten or loosen the lid 230. As can be seen in FIG. 3B, an interior 235 of the lid 230 has threads 233 on a rim 232 of the lid 230. These threads 233 interact with the threads 221 of the container 220. Depending on the orientation of both the threads 233 of the lid 230 and the threads 221 of the container 220, the lid may be turned in either a clockwise or counterclockwise direction to tighten and can then be loosened by turning the lid 230 in the opposite direction.

Figure 4A:
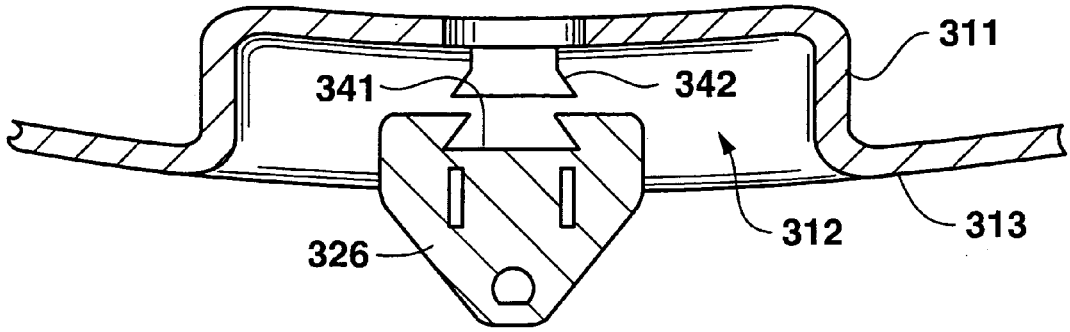
FIGS. 4A, 4B, and 4C show cross-sectional views of container side walls employing different locking devices in a storage device according to the present invention.
Figure 4B:
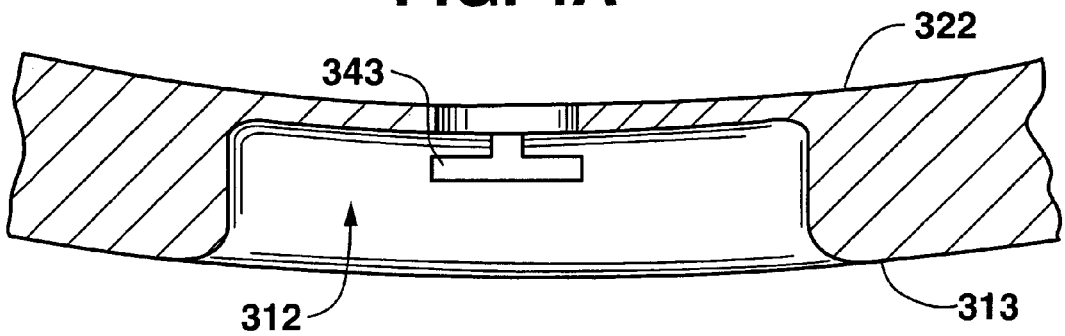
Figure 4C:
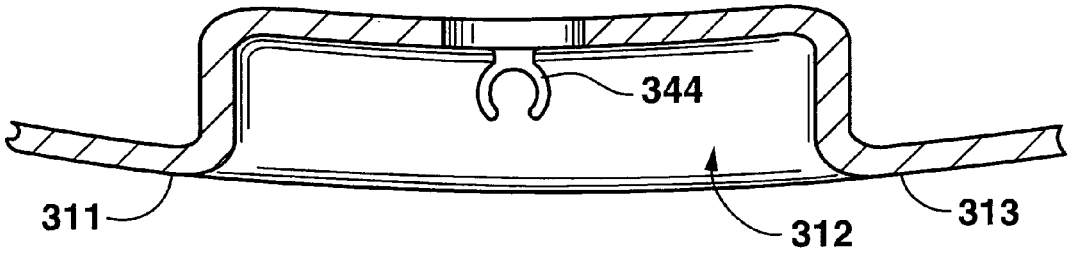

FIGS. 4A–4C show further embodiments of locking devices used to hold male and female ends of a cord in indentions of a container of a storage device according to the invention. FIG. 4A shows a cutaway view of a section of a container at an indention 312 formed in an outer perimeter 313 by sidewalls 311. The sidewalls 311 form an integral locking device 342 within the indention 312. The cross-sectional shape of the locking device 342, in this case a trapezoidal shaped knob with its longer base surface protruding within the indention, provides a male end that allows an end 326 of an extension cord having a corresponding female receptor 341 to lock onto the trapezoidal shape locking device 342, thereby holding the end 326 of the cord within the indention 312 to protect and control the end 326.

FIG. 4B illustrates another embodiment of the locking device of the present invention. In this case, the sidewalls 322 form an indention 312 in the outer perimeter 313 of a container with the sidewalls 322 forming a T-bar shaped locking device 343. As with the locking device illustrated in FIG. 4A, an end of a cord will have a corresponding female receptor that will allow the end of the cord to fit onto the T-bar shaped locking device 343. In this manner, the end of the cord locks onto the container within the indention 312 protecting and controlling that end.

FIG. 4C shows still a further embodiment with sidewalls 311 forming an indention 312 in an outer perimeter 313 of the container having a clip shape locking device 344 attached therein. This clip shape locking device 344 allows a portion of the cord near an end of the cord to be snapped into the clip 344, thereby holding the end of the cord within the indention 312 formed by the sidewalls 311. In this manner, a regular cord without any specially designed end can be attached to the side of the container within the indention 312 to allow the cord to be safely stored within the storage container. The clips also control the ends of the cord to prevent the ends from interacting with the cord in the container, further limiting any opportunities for entanglements.

The locking device may be any shape or mechanism that holds the ends of the cord safely within the indentions formed by the sidewalls of the container. Further, these locking devices may be an integral part of the sidewalls as illustrated or may be mechanically, thermally, or chemically attached to the sidewalls. Examples of such attachments would be screwing the locking devices into the sidewall, adhesively attaching the locking devices to the sidewall, or thermally bonding the locking devices to the sidewall. As illustrated, these locking devices may interact specifically with the ends of the cord that is to be stored in the storage device or may interact with a part of the cord proximal to the ends of the cord. In some exemplary embodiments, at least a portion of the locking devices may be integral with the ends of the cord.

It should be well understood that, in some embodiments like in FIG. 5, a single locking device may be used to hold both ends of the cord within an indention. For example, a clamp, a single unit having two clips, or plug-in/slide-on devices may be used. Further, it should also be understood that multiple locking devices may be used to hold a single end of a cord within each indention.

In general, the container should be made out of a material, which is sturdy enough to permit weight to be placed on both the lid and the container, thereby allowing multiple storage devices to be stackable or just allowing other objects to be placed on top of them. As such, depending on the material used to manufacture the container, the sidewalls may be thicker as shown in FIG. 4B or may be thinner as shown in FIGS. 4A and 4C. As can be seen in FIG. 4B, if the sidewalls 322 are thick enough, the indention may be cut into the sidewalls 322 forming a thinner portion of the sidewalls 322 at the indention 312. In the alternative, as shown in FIGS. 4A and 4C, the sidewalls 311 may be molded in such a manner that the thickness does not change at the indention 312.

The present invention creates an easy way to store and protect electric extension cords in a manner that prevents entanglements within the cord and allows quick and easy distribution and insertion of the cord. The random first-in last-out placement of the cord in the container is more easily performed and less tedious than winding the cord into a coil, and it also better protects and preserves the integrity of the extension cord. The design of the container and lid also better protects the cord and cord ends from unnecessary damage and wear than the prior art.

It will be appreciated by those skilled in the art that various modifications and variations can be made in the present invention without departing from the scope of the invention. It is intended that the present invention include such modifications and variations as come within the scope of the appending claims and their equivalents.

What is claimed:

1. A storage device for an electric extension cord having a male end and a female end, said storage device comprising:

a rigid container for holding said electric extension cord, said container having sidewalls that form an outer perimeter of the container and form a container opening in a top portion of said container;

said sidewalls of said container forming at least one indention in said outer perimeter of said container proximal to said container opening and said sidewalls forming an aperture in said at least one indention, said aperture permitting at least one of said male end and said female end of said extension cord to be extendable outside of said container when said extension cord is placed in said container;

a locking device positioned in said at least one indention formed in said outer perimeter of said container proximal to said aperture formed by said sidewalls, said locking device holding at least one of said male end and said female end of said extension cord within said at least one indention in said outer perimeter; and a lid for covering said opening of said container attachable to said container.

2. A storage device as in claim 1, wherein said aperture formed by said sidewalls is a recess along an edge of said sidewalls in said at least one indention integral to said container opening.

3. A storage device as in claim 1, wherein said lid is screwed onto the container.

4. A storage device as in claim 3, further comprising detents integral to said top portion of said container, said detents engaging the lid when said lid is screwed onto said container.

5. A storage device as in claim 1, wherein said container defines a handle by which said storage device may be lifted.

6. A storage device as in claim 1, wherein said lid defines a handle by which said storage device may be lifted.

7. A storage device as in claim 6, wherein said handle is flush with an outer surface of said lid.

8. A storage device as in claim 1, wherein said aperture receives said cord in a non-binding engagement.

9. A storage device as in claim 1, wherein said lid provides an outer surface that permits multiple storage devices to be stackable atop one another.

10. A storage device as in claim 1, wherein at least two locking devices are positioned in said at least one indention formed in said outer perimeter of said container proximal to said aperture formed by said sidewalls, said at least two locking devices holding said male end and said female end of said extension cord within said at least one indention in said outer perimeter.

11. A storage device as in claim 10, wherein said at least two locking devices comprise a female plug-in that accepts said male end of said cord and a male plug that enters said female end of said cord.

12. A storage device as in claim 10, wherein said at least two locking devices comprise clips for engaging said cord in a manner that holds said male end and said female end of the cord in said indention.

13. A storage device as in claim 10, wherein said at least two locking devices are at least partially formed by said male and female ends of said cord.

14. A storage device as in claim 13, wherein said at least two locking devices comprise male-shaped extensions that correspond to a female receptor on each of said ends of said cord.

15. A storage device as in claim 13, wherein said at least two locking devices comprise snap buttons.

16. A storage device as in claim 1, wherein said sidewalls form at least two apertures in said sidewalls within said at least one indention.

17. A storage device as in claim 16, wherein at least two locking devices are positioned in said at least one indention formed in said outer perimeter of said container proximal to said at least two apertures formed by said sidewalls, said at least two locking devices holding said male end and said female end of said extension cord within said at least one indention in said outer perimeter.

18. A storage device as in claim 1, wherein said sidewalls of said container form two indentions in said outer perimeter of said container proximal to said container opening and said sidewalls form two apertures so that one of said two apertures are located in each of said two indentions, thereby each aperture permitting one of said male and said female ends of said extension cord to be extendable outside of said container when said extension cord is placed in said container.

19. A storage device as in claim 5, wherein at least two locking devices are positioned on said sidewalls so that at least one of said two locking devices is located in each of said two indentions proximal to said aperture located therein.

20. A storage device for an electric extension cord having a first end and a second end, said storage device comprising:

a rigid container for holding said electric extension cord, said container having sidewalls that form an outer perimeter of the container and form a container opening in a top portion of said container along an edge of said sidewalls;

said sidewalls of said container forming at least one indention in said outer perimeter of said container proximal to said container opening and said sidewalls forming at least one of a first recess and a second recess along said edge of said sidewalls in said at least one indention integral to said container opening, said first recess permitting said first end to be extendable outside of said container and said second recess permitting said second end to be extendable outside of said container when said cord is placed in said container;

at least one of a first locking device and a second locking device positioned in said at least one indention formed in said outer perimeter of said container with said first locking device proximal to said first recess for holding said first end of said extension cord and said second locking device proximal to said second recess for holding said second end of said extension cord, so that said first and second locking devices hold said first and second ends of said extension cord within said at least one indention in said outer perimeter; and a lid for covering said opening of said container attachable to said container.

21. A storage device as in claim 20, wherein said sidewalls of said container form a first indention and a second indention in said outer perimeter of said container proximal to said container opening with said first recess and said first locking device located in said first indention and said second recess and said second locking device located in said second indention.

22. A storage device as in claim 21, wherein said first and second locking devices comprise male-shaped extensions that correspond to a female receptor on each of said first and second ends of said cord.

23. A storage device as in claim 21, wherein said at least first and second locking devices comprise clips for engaging said cord in a manner that holds said male end and said female end of the cord in said indention.

24. A storage device as in claim 21, wherein said lid defines a handle by which said storage device may be lifted.

25. A storage device as in claim 24, wherein said handle is flush with an outer surface of said lid.

26. A storage device as in claim 21, wherein said container defines a handle by which said storage device may be lifted.

27. A storage device as in claim 21, wherein said first and second recesses receive said cord in a non-binding engagement.

28. A storage device as in claim 21, wherein said lid provides an outer surface that permits multiple storage devices to be stackable atop one another.

* * * * *